US009902564B1

(12) United States Patent
Huang et al.

(10) Patent No.: US 9,902,564 B1
(45) Date of Patent: Feb. 27, 2018

(54) ROLLER ASSEMBLY, STEP ROLLER THEREOF, AND METHOD FOR TRANSPORTING SUBSTRATE USING THE SAME

(71) Applicants: Industrial Technology Research Institute, Hsinchu (TW); ATMA CHAMP ENT. CORP., New Taipei (TW)

(72) Inventors: Kuo-Hsin Huang, Hsinchu County (TW); Chao-Feng Sung, Hsinchu (TW); Yu-Lin Hsu, Tainan (TW); Hsin-Yun Hsu, Hsinchu County (TW); I-Chung Kao, New Taipei (TW); Kuo-Jung Sun, New Taipei (TW); Shou-Cheng Shen, Taipei (TW); Kai Chang, New Taipei (TW)

(73) Assignees: Industrial Technology Research Institute, Hsinchu (TW); ATMA CHAMP ENT. CORP., New Taipei (TW)

( * ) Notice: Subject to any disclaimer, the term of this patent is extended or adjusted under 35 U.S.C. 154(b) by 0 days.

(21) Appl. No.: 15/390,542

(22) Filed: Dec. 26, 2016

(51) Int. Cl.
*B65G 13/00* (2006.01)
*B65G 39/07* (2006.01)
*B65H 20/12* (2006.01)

(52) U.S. Cl.
CPC ..... *B65G 39/07* (2013.01); *B65H 20/12* (2013.01)

(58) Field of Classification Search
CPC ..... B65H 20/12; B65H 2406/1115; B65H 2406/1132; B65H 23/32; B65H 5/226; B65H 5/222; B65H 5/228
See application file for complete search history.

(56) References Cited

U.S. PATENT DOCUMENTS

| | | | | |
|---|---|---|---|---|
| 4,145,040 | A | 3/1979 | Huber | |
| 4,437,659 | A | 3/1984 | Caron et al. | |
| 4,973,991 | A | 11/1990 | Raijmahers | |
| 6,336,608 | B1 * | 1/2002 | Cope | B65H 23/24 226/97.1 |
| 6,427,941 | B1 | 8/2002 | Hikita | |
| 8,936,243 | B1 | 1/2015 | Muir et al. | |
| 9,242,828 | B2 | 1/2016 | Mader | |
| 2011/0135405 | A1 * | 6/2011 | Miyaji | B65H 23/24 406/70 |
| 2014/0284412 | A1 | 9/2014 | Merz et al. | |

FOREIGN PATENT DOCUMENTS

| | | |
|---|---|---|
| CN | 101489893 | 7/2009 |
| TW | 201531408 | 8/2015 |

* cited by examiner

*Primary Examiner* — William R Harp
(74) *Attorney, Agent, or Firm* — JCIPRNET

(57) ABSTRACT

A roller assembly for transporting a substrate includes a step roller, a first transport roller, and a second transport roller. The step roller includes a main roller, an air cylinder, and a pair of edge rollers. The air cylinder is sleeved on the main roller, and includes a plurality of air jetting holes and a plurality of air suction holes. The edge rollers are disposed on the main roller and are located on opposite ends of the air cylinder. The first transport roller and the second transport roller are disposed on opposite sides of the step roller, wherein the substrate is transported from the first transport roller to the second transport roller through the step roller. A method using the same is also provided.

31 Claims, 13 Drawing Sheets

ROLLER ASSEMBLY, STEP ROLLER THEREOF, AND METHOD FOR TRANSPORTING SUBSTRATE USING THE SAME

TECHNICAL FIELD

The technical field relates to a roller assembly, step roller, and method for transporting a substrate using the same.

BACKGROUND

During roll to roll processing in roller assemblies, when substrates or films are transported from one roller to another roller, the substrates or films may have patterns that were formed on the substrates. In order to prevent the patterns from being damaged, the substrates or films are transported through a step roller so that the patterns do not contact the rollers directly. Since the patterns do not contact the rollers through the step roller, the substrates or films are transported without damaging the patterns on them.

However, conventional step rollers do not support the middle of the substrate or film they are transporting because the patterns are in the middle of the substrate. During transporting the substrate through the step roller, stress is generated from the bending moment towards the substrate. Because the substrate is not supported in the middle, stress generated from the bending moment may cause the substrate or film to be wrinkled or damaged. If the substrate is damaged, the substrate is not able to be properly transported. In addition, the pattern on the substrate may also be damaged.

SUMMARY

An exemplary embodiment of the disclosure provides a roller assembly for transporting a substrate. The roller assembly includes a step roller, a first transport roller, and a second transport roller. The step roller includes a main roller, an air cylinder, and a pair of edge rollers. The air cylinder is sleeved on the main roller, and includes a plurality of air jetting holes and a plurality of air suction holes. The edge rollers are disposed on the main roller and are located on opposite ends of the air cylinder. The first transport roller and the second transport roller are disposed on opposite sides of the step roller, wherein the substrate is transported from the first transport roller to the second transport roller through the step roller.

An exemplary embodiment of the disclosure provides a step roller adapted to transport a substrate. The step roller includes a main roller, an air cylinder, and a pair of edge rollers. The air cylinder is sleeved on the main roller, and includes a plurality of air jetting holes and a plurality of air suction holes. The edge rollers are disposed on the main roller and are located on opposite ends of the air cylinder.

An exemplary embodiment of the disclosure provides a step roller adapted to transport a substrate. The step roller includes a main roller and a pair of edge rollers. A plurality of air jetting holes and a plurality of air suction holes are arranged on the main roller. The edge rollers are disposed on the main roller and located on opposite ends of the main roller. The air jetting holes and the air suction holes are distributed between the pair of edge rollers.

An exemplary embodiment of the disclosure provides a step roller adapted to transport a substrate. The step roller includes a main roller and a pair of edge rollers. A plurality of air jetting holes and a plurality of air suction holes are arranged on the main roller. The air jetting holes or the air suction holes are disposed on an arc length of a circumference of the main roller, and an angle of the arc length is equal to or less than 180 degrees. The edge rollers are disposed on the main roller and located on opposite ends of the main roller. The air jetting holes and the air suction holes are distributed between the pair of edge rollers.

An exemplary embodiment of the disclosure provides a method for transporting a substrate with a roller assembly. The substrate is radially transported through a step roller. Air is jetted between the substrate and a main roller of the step roller from a plurality of air jetting holes of an air cylinder sleeved on the main roller. Air between the substrate and the main roller is suctioned into a plurality of air suction holes of the air cylinder sleeved on the main roller. The edges of the substrate are supported by a pair of edge rollers.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF EMBODIMENTS

Figure 1:
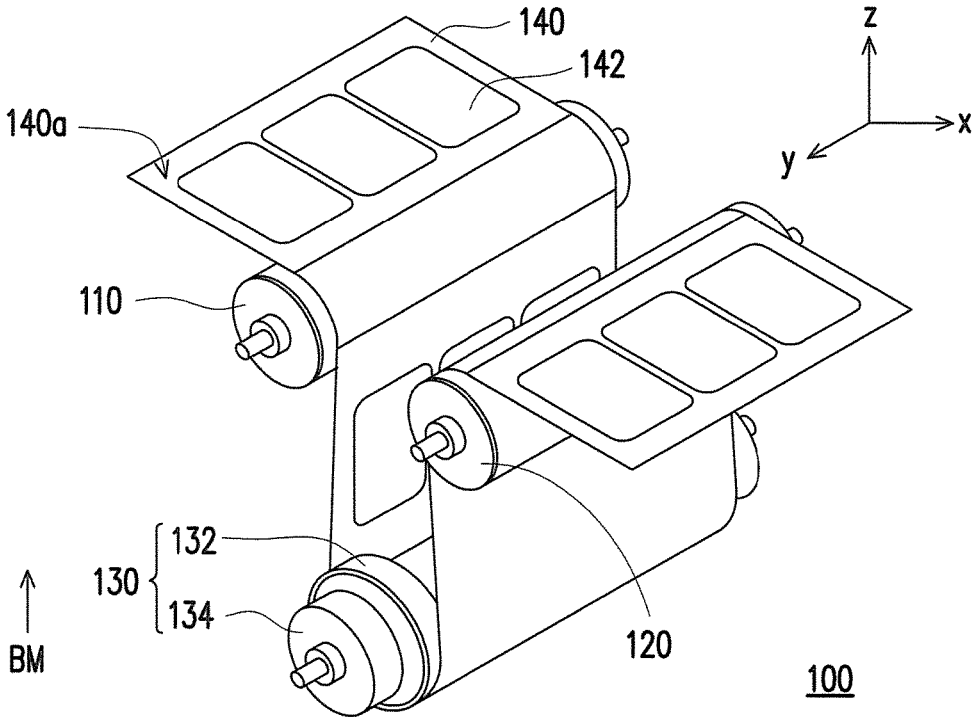
FIG. 1 is a three-dimensional schematic diagram of a roller assembly according to an embodiment of the disclosure.
Figure 2:
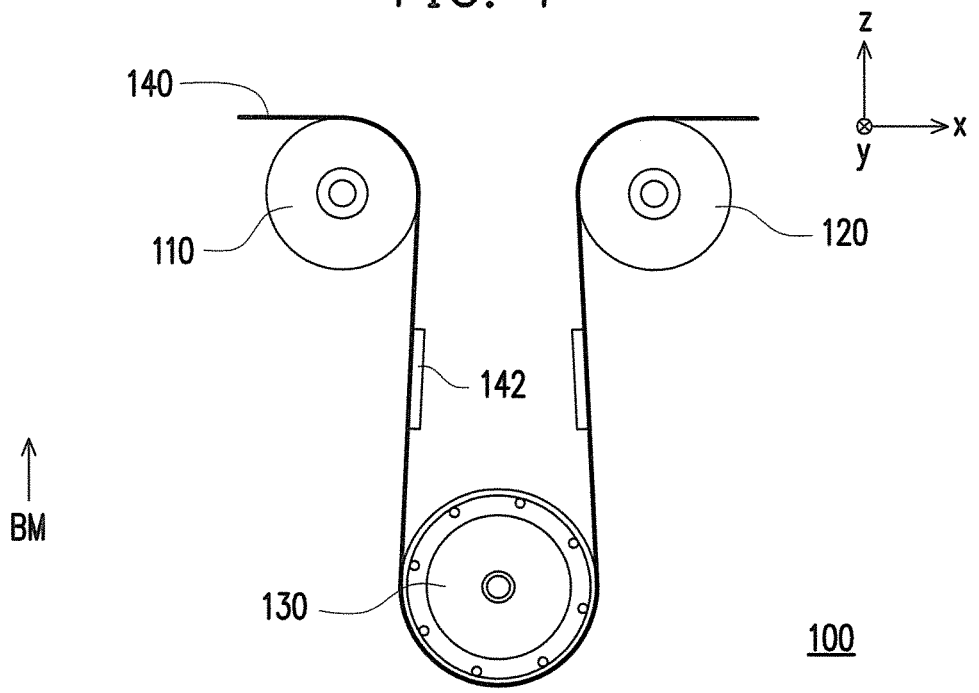
FIG. 2 is a schematic side view of the roller assembly of FIG. 1.

FIG. 1 is a three-dimensional schematic diagram of a roller assembly according to an embodiment of the disclosure. FIG. 2 is a schematic side view of the roller assembly of FIG. 1. In the embodiment, the roller assembly 100 includes a first transport roller 110, a second transport roller 120, and a step roller 130. The roller assembly 100 is suitable for roll to roll processing. The first transport roller 110 and the second transport roller 120 are disposed on opposite sides of the step roller 130. A substrate 140 with patterns 142 is transported from the first transport roller 110 to the second transport roller 120 through the step roller 130. In other embodiments, the substrate 140 that is transported does not have to include patterns 142. The substrate 140 or web is, for example, any suitable material to be processed in roll to roll processing such as paper, glass, polyethylene terephthalate (PET), polyimide (PI), or Polyurethane (PU). The patterns 142 are any suitable patterns formed on the substrate 140 desired by the user. The material of the patterns 142 are, for example, semiconductor material, metal, organic material, or any other suitable material. The patterns 142 are, for example, printed or deposited on the substrate 140. However, the disclosure is not limited thereto, and the patterns 142 may be fol ed on the substrate 140 through any other suitable method. In the embodiment, multiple patterns 142 are shown. However, the disclosure is not limited thereto, and the number of patterns 142 may be determined and adjusted according to user requirements.

In the embodiment, when the substrate 140 is transported from the first transport roller 110 to the second transport roller 120, a side 140*a* with the patterns 142 faces away from the first transport roller 110 and the second transport roller 120. That is to say, the side 140*a* with the patterns 142 does not contact the first transport roller 110 and the second transport roller 120 so that the patterns 142 are not damaged while the substrate 140 is rolling on the first transport roller 110 and the second transport roller 120. In addition, the side 140*a* with the patterns 142 faces the step roller 130. Specifically, as seen in FIG. 1, the step roller 130 includes a pair of edge rollers 132 and a main roller 134. The edge rollers 132 are sleeved on the main roller 134. When the substrate 140 is transported through the step roller 130, the side 140*a* of the substrate 140 with the patterns 142 is in contact with the edge rollers 132. Since the edge rollers 132 support the two sides of the substrate 140, the patterns 142 do not contact the edge rollers 132 or the main roller 134. This way, the patterns 142 are not damaged when the substrate 140 is transported through the step roller 130. As the substrate 140 is transported through the step roller 130, the edge rollers 132 and the main roller 134 rotate together. The edge rollers 132 are fixed to the main roller 134 through, for example, welding, adhering, fastening, or any other suitable method such that the edge rollers 132 rotate with the main roller 134. In other embodiments, the edge rollers 132 and the main roller 134 is integrally formed.

Figures 3, 4:
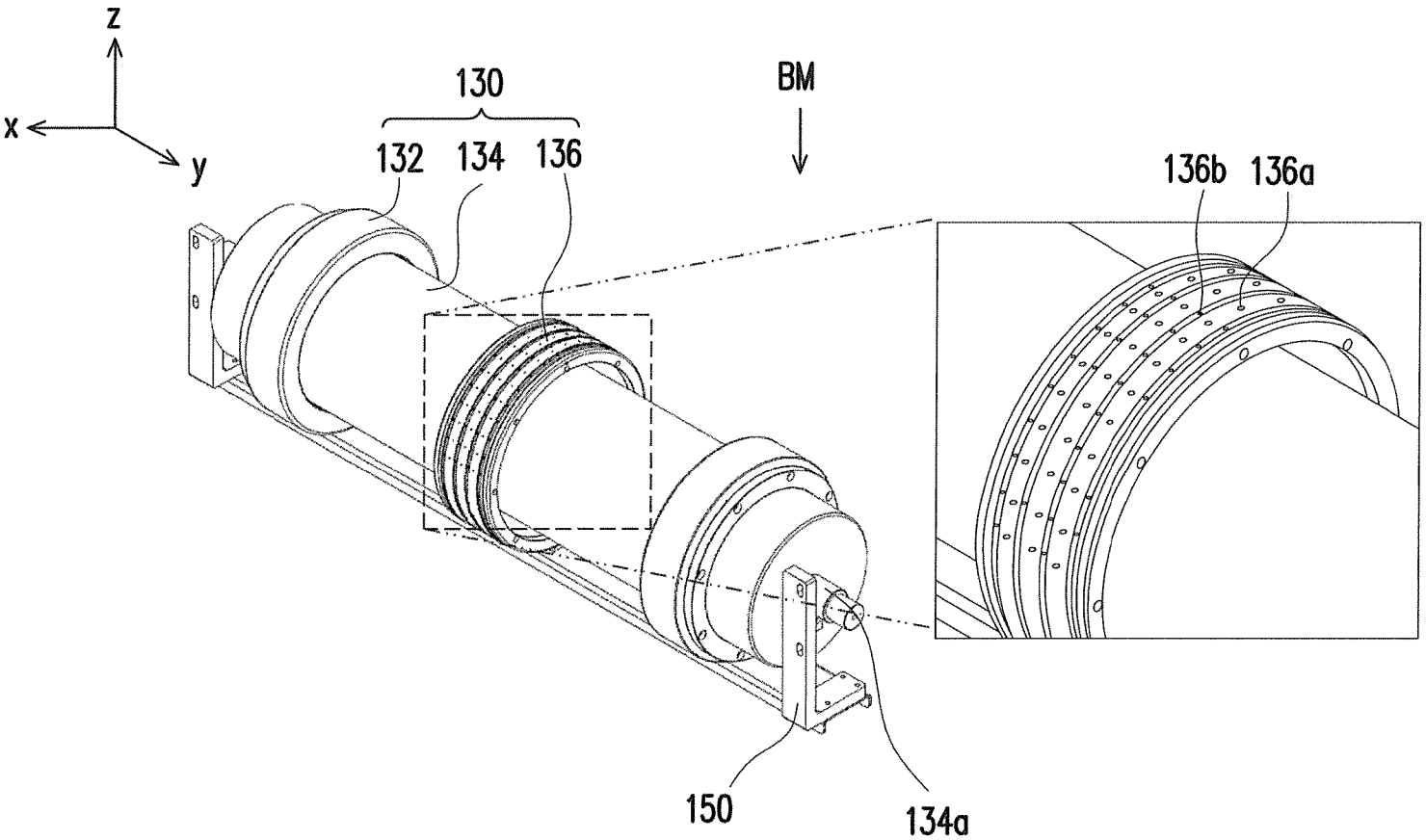
FIG. 3 is a schematic three-dimensional diagram of a step roller of FIG. 1.
FIG. 4 is a partial enlarged view of the schematic diagram illustrating the step roller in FIG. 3.

FIG. 3 is a schematic three-dimensional diagram of a step roller of FIG. 1. FIG. 4 is a partial enlarged view of the schematic diagram illustrating the step roller in FIG. 3. As seen in FIG. 3 and FIG. 4, in the embodiment, the step roller 130 includes the pair of edge rollers 132, the main roller 134, and an air cylinder 136. The air cylinder 136 is sleeved on the main roller 134, and the edge rollers 132 are located on opposite ends of the air cylinder 136. The air cylinder 136 includes a plurality of air jetting holes 136*a* and a plurality of air suction holes 136*b*. In addition, the air cylinder 136 is located around the middle of the main roller 134, and a length of the air cylinder 136 is less than a distance between the pair of edge rollers 132. That is to say, the air cylinder 136 does not cover the entire distance between the pair of edge rollers 132.

In the embodiment, air is adapted to be jetted out of the air jetting holes 136*a*, and air is adapted to be suctioned into the air suction holes 136*b*. Referring to FIG. 4, it can be seen that the air jetting holes 136*a* and the air suction holes 136*b* are respectively aligned in the alternating rows, wherein the rows are in a circumferential direction of the air cylinder 136. That is to say, the air suction holes 136*b* and the air jetting holes 136*a* are not in the same row in a circumferential direction of the air cylinder 136. In the length direction (y-direction) of the air cylinder 136, the air jetting holes 136*a* and the air suction holes 136*b* are alternately aligned. The air jetting holes 136*a* and the air suction holes 136*b* face the substrate 140 as the substrate 140 is being transported through the step roller 130. Therefore, the air jetted out by the air jetting holes 136*a* are able to provide the substrate 140 with an additional support point near the middle, since the air cylinder 136 is near the middle of the main roller 134. That is to say, the air jetted from the air jetting holes 136*a* push the substrate 140 in the opposite direction of the bending moment (bending moment direction shown as BM in FIGS. 1, 2, and 3) on the substrate 140. Thus, this relieves the stress towards the substrate 140 while the substrate 140 is transported through the step roller 130, and may prevent the substrate 140 from being wrinkled or damaged.

Figure 5:
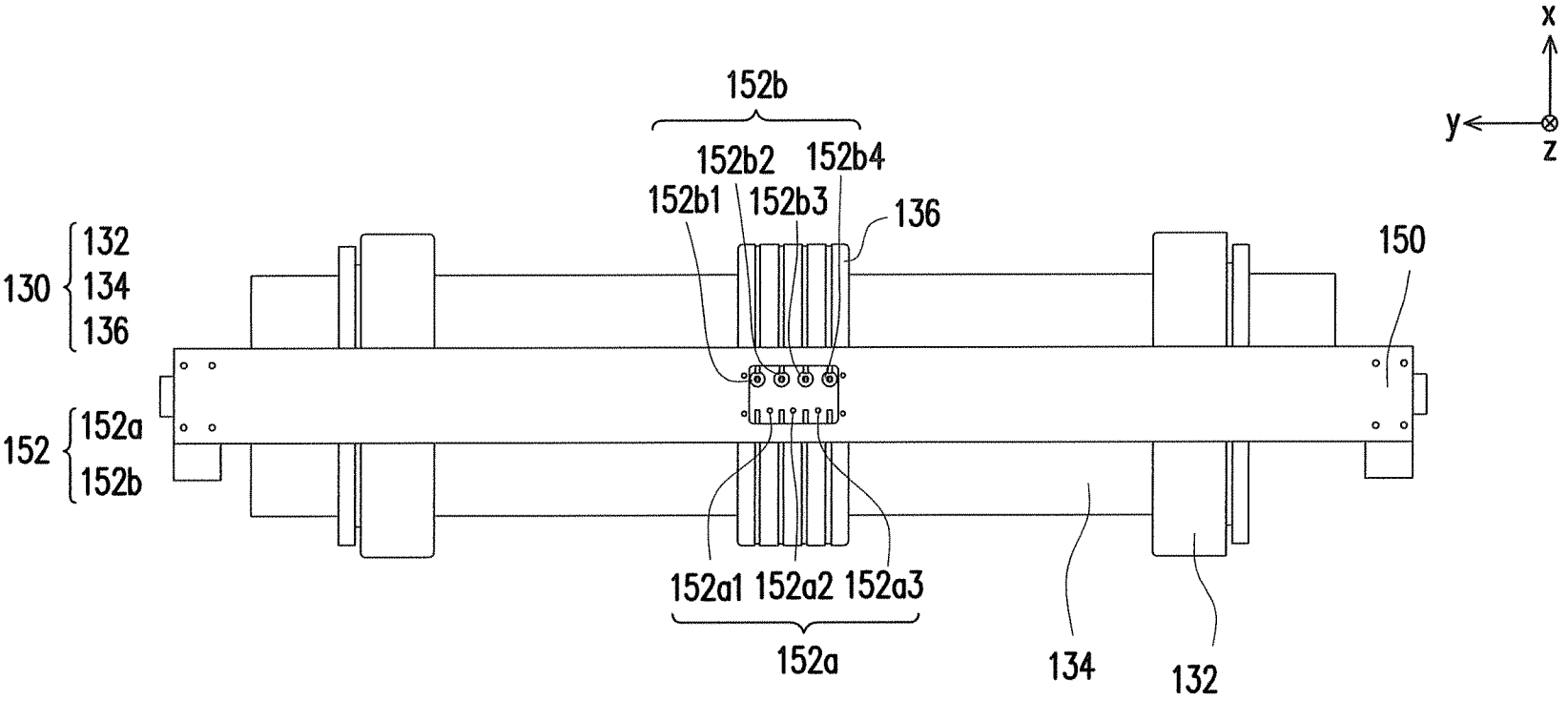
FIG. 5 is a schematic bottom view of the step roller of FIG. 3.

FIG. 5 is a schematic bottom view of the step roller of FIG. 3. As seen in FIG. 3 and FIG. 5, a support frame 150 is further connected to the step roller 130 to support the air cylinder 136. The support frame 150 is connected to both ends of an axis support 134*a* of the main roller 134, and extends along the length direction of the main roller 134. The axis support 134*a* does not rotate with the edge rollers 132 and the main roller 134. Therefore, the support frame 150 does not rotate, and is fixed so as to support the air cylinder 136. Since the air cylinder 136 is supported and fixed on the support frame 150, the air cylinder 136 is not fixed to the main roller 134, and does not rotate with the main roller 134. That is to say, the air cylinder 136 is spaced apart from the main roller 134 and does not rotate with the main roller 134. This way, the air jetting holes 136*a* and the air suction holes 136*b* do not move and face the same direction towards the substrate 140 while the substrate 140 is being transported through the step roller 130. However, the disclosure is not limited thereto. In other embodiments, the support frame 150 is connected to any fixed portion of the roller assembly 100. That is to say, the support frame 150 may be connected to either the step roller 130, the first transport roller 110, the second transport roller 120, or any other component in the roller assembly 100 that is suitable to be connected to the support frame 150 such that the support frame 150 is fixed.

Further referring to FIG. 5, in the embodiment, the support frame 150 has a connecting portion 152. The connecting portion 152 is adapted to be connected to an air supplier 170 (shown in FIG. 7A and FIG. 7B) and a vacuum system 160 (shown in FIG. 7A and FIG. 7B). The air supplier 170 and the vacuum system 160 are any suitable machine or system required by the user known to one of ordinary skill in the art. That is, the air supplier 170 provides air (jets air), and the vacuum system 160 suctions air. Specifically, the connecting portion 152 includes a plurality of supplying holes 152*a* (152*a*1, 152*a*2, 152*a*3) and a plurality of vacuum holes 152*b* (152*b*1, 152*b*2, 152*b*3, 152*b*4). In the embodiment, three supplying holes 152*a* are shown and four vacuum holes 152*b* are shown. However, the number of supplying holes 152*a* and vacuum holes 152*b* may be adjusted as required by the user. The supplying holes 152*a* are connected to the air supplier 170 through any suitable method. For example, the supplying holes 152*a* are connected to the air supplier through valves, tubes, pipes, or a combination of the above. Similarly, the vacuum holes 152*b* are connected to the vacuum system 160 through valves, tubes, pipes, or a combination of the above. The supplying holes 152*a* are connected to the air jetting holes 136*a* such that the air from the air supplier 170 enters the supplying holes 152*a* and exits from the air jetting holes 136*a*. Furthermore the vacuum holes 152*b* are connected to the air suction holes 136*b* such that air is suctioned in from the air suction holes 136*b* and enters the vacuum system 160 through the vacuum holes 152*b*.

In the embodiment, the pressure and rate of air jetted from the air jetting holes 136*a* is controlled by air supplier 170 in conjunction with the vacuum system 160. The rate of air suctioned into the air suction holes 136*b* is controlled by the vacuum system 160 in conjunction with the air supplier 170. That is to say, the air supplier 170 and the vacuum system 160 are controlled such that the air jetted out of the air jetting holes 136*a* is enough to support the substrate 140 from wrinkling due to the stress from the bending moment. In addition, the pressure from the air jetted out of the air jetting holes 136*a* is controlled so that the air does not damage the patterns 142 on the substrate 140. In the embodiment, the rate of air suctioned by the air suction holes 136*b* is controlled so that the rate is enough to support substrate 140 but not lose stability of the substrate 140 being transported. Specifically, the substrate 140 is in contact with the edge rollers 132 and while being transported covers about half of the step roller 130. The space between the edge rollers 132 is covered by the substrate 140. Thus, if the air is continuously jetted out of the air jetting holes 136*a*, the air has no clear exit, and the substrate 140 will float and in some cases, lose stability. By losing stability, the substrate 140 may undesirably change position or be harder to control during transportation. Therefore, while the air is jetted out of the air jetting holes 136*a*, the air suction holes 136*b* suctions in the air. Thus, the air has a place to exit, and the system has better stability. By controlling the rate the air is supplied and suctioned out, the substrate 140 is both supported and transportation of the substrate 140 through the step roller is stable.

Figure 6:
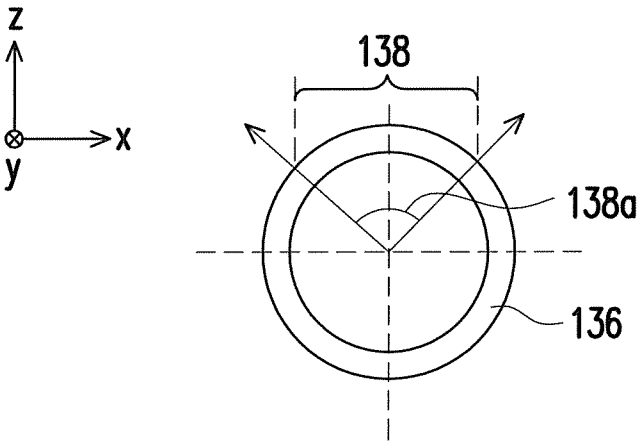
FIG. 6 is a schematic side view of an air cylinder of FIG. 3.

FIG. 6 is a schematic side view of an air cylinder of FIG. 3. Referring to FIG. 6, FIG. 6 shows an arc length 138 of the air cylinder 136, and an angle 138*a* of the arc length 138 of the air cylinder 136. Specifically, the air jetting holes 136*a* and the air suction holes 136*b* are disposed on the arc length 138 of the circumference of the air cylinder 136. In the embodiment, the angle 138*a* of the arc length 138 is substantially equal to or less than 180 degrees. Specifically, the angle 138*a* of the arc length 138 is, for example, 160 degrees. However, the disclosure is not limited thereto, and the angle 138*a* of the arc length 138 may be adjusted as required by the user.

Figure 7A:
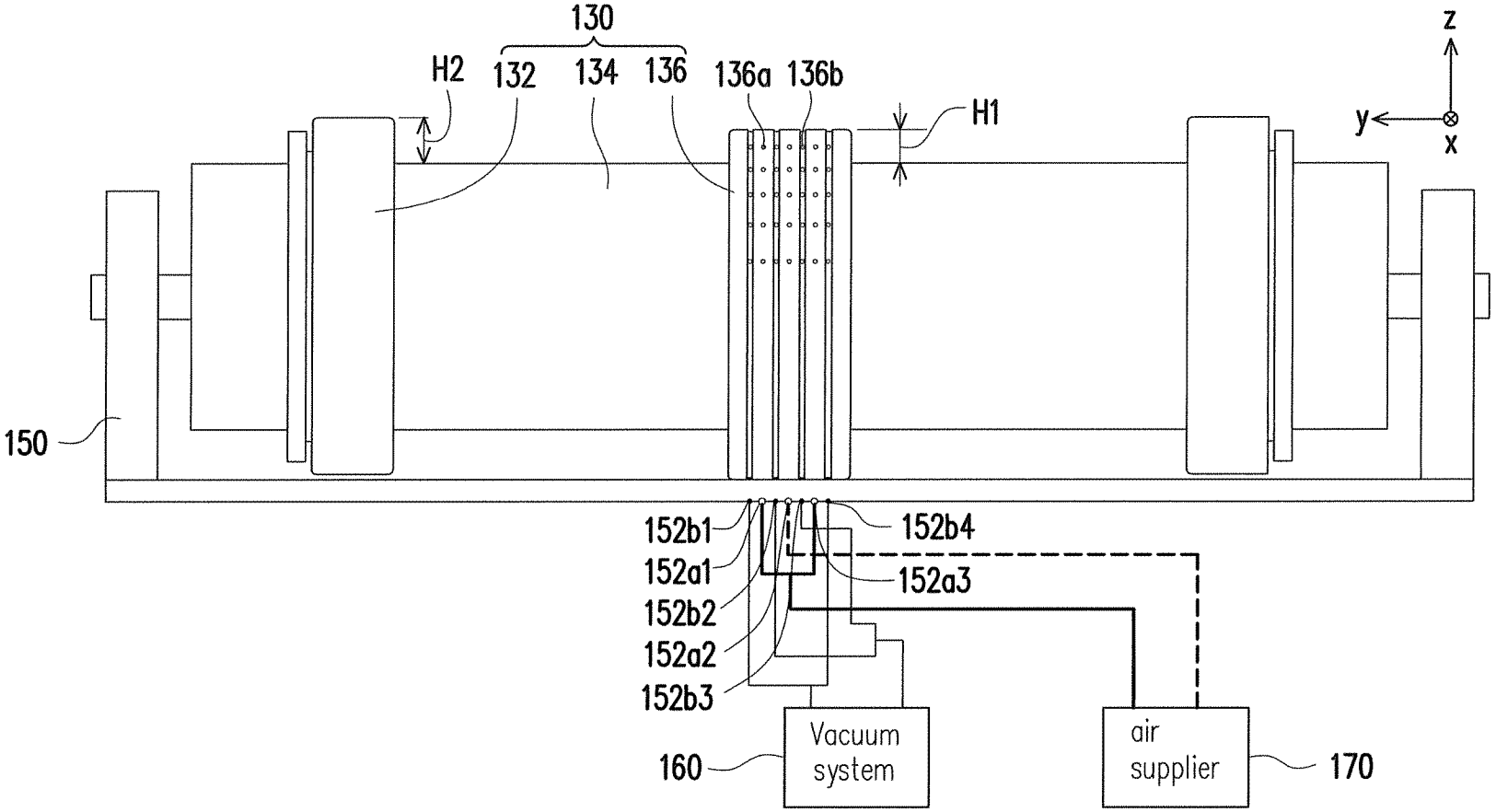
FIG. 7A is a schematic front view of the step roller of FIG. 3 according to an embodiment of the disclosure.

FIG. 7A is a schematic front view of the step roller of FIG. 3 according to an embodiment of the disclosure. As seen in FIG. 7A, a maximum height H1 from the air cylinder 136 to the main roller 134 is less than a maximum height H2 of the edge rollers 132 to the main roller 134. That is to say, the edge rollers 132 are higher than the air cylinder 136. This way, as the substrate 140 is being transported through the step roller 130, the edge rollers 132 support the substrate 140. Since the edge rollers 132 are higher than the air cylinder 136, the substrate 140 does not come in contact with the air cylinder 136. That is to say, there is a gap between the air cylinder 136 and the substrate 140 while the substrate 140 is transported through the step roller 130. Because the substrate 140 does not come in contact with the air cylinder 136, the patterns 142 on the substrate 140 do not contact the air cylinder 136. This prevents the patterns 142 on the substrate 140 from being damaged while the substrate 140 is transported through the step roller 130.

Furthermore, as seen in FIG. 7A, according to the embodiment, the supplying holes 152*a*1, 152*a*2, 152*a*3 are connected to the air supplier 170. Specifically, the supplying holes 152*a*1, 152*a*3 are connected to the same tube connected to the air supplier 170 such that the supplying holes 152*a*1, 152*a*3 supply air at the same rate. Thus, the rows of air jetting holes 136*a* respectively connected to the supplying holes 152*a*1, 152*a*3 jet air at the same rate. The supplying hole 152*a*2 is connected to the air supplier 170 through a different tube separate from the supplying holes 152*a*1, 152*a*3. Thus, the rate of air supplied to the supplying hole 152*a*2 is independent from the rate of air supplied to the supplying holes 152*a*1, 152*a*3. Thus, the row of air jetting holes 136*a* connected to the supplying hole 152*a*2 jets air at a rate that is independent from the rate of air jetted from the row of air jetting holes 136*a* connected to the supplying holes 152*a*1, 152*a*3. Even though the supplying hole 152*a*2 is independently connected to the air supplier 170 from the supplying holes 152*a*1, 152*a*3, the rate of air supplied to the supplying hole 152*a*2 may be the same or different from the rate of air supplied to the supplying holes 152*a*1, 152*a*3.

In addition, according to the embodiment, the vacuum holes 152*b*1, 152*b*2, 152*b*3, 152*b*4 are connected to the vacuum system 160. Specifically, the vacuum holes 152*b*1, 152*b*4 are connected to the same tube connected to the vacuum system 160 such that the vacuum holes 152*b*1, 152*b*4 suction air at the same rate. Thus, the rows of air suctioning holes 136*b* respectively connected to the vacuum holes 152*b*1, 152*b*4 suction air at the same rate. The vacuum holes 152*b*2, 152*b*3 are connected to the same tube connected to the vacuum system 160 such that the vacuum holes 152*b*2, 152*b*3 suction air at the same rate. Thus, the rows of air suctioning holes 136*b* respectively connected to the vacuum holes 152*b*2, 152*b*3 suction air at the same rate. The tube connecting the vacuum holes 152*b*2, 152*b*3 to the vacuum system are independent from the tube connecting the vacuum holes 152*b*1, 152*b*4. Thus, the rate of air suctioned by the vacuum holes 152*b*1, 152*b*4 is independent from the rate of air suctioned by the vacuum holes 152*b*2, 152*b*3. Even though the vacuum holes 152*b*2, 152*b*3 are independently connected to the vacuum system 160 from the vacuum holes 152*b*1, 152*b*4, the rate of air vacuumed by the vacuum holes 152*b*2, 152*b*3 may be the same or different from the rate of air vacuumed by the vacuum holes 152*b*1, 152*b*4.

Figure 7B:
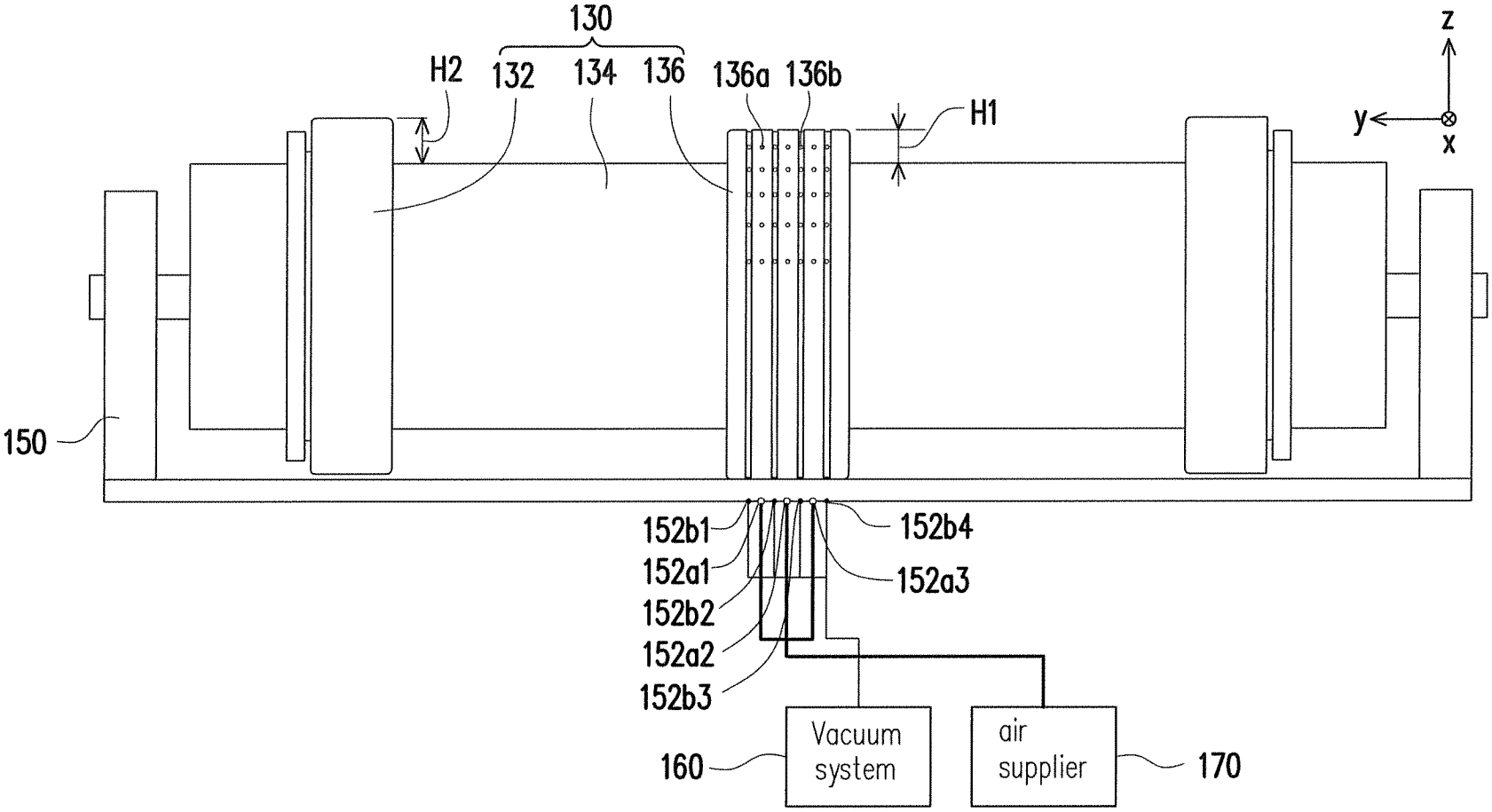
FIG. 7B is a schematic front view of the step roller of FIG. 3 according to another embodiment of the disclosure.

FIG. 7B is a schematic front view of the step roller of FIG. 3 according to another embodiment of the disclosure. FIG. 7B is similar to FIG. 7A, and the same descriptions will not be repeated herein. The difference is in the embodiment of FIG. 7B, the vacuum holes 152*b*1, 152*b*2, 152*b*3, 152*b*4 are connected to the vacuum system 160 through the same tube, such that the vacuum holes 152*b*1, 152*b*2, 152*b*3, 152*b*4 suction air at the same rate. In addition, the supplying holes 152*a*1, 152*a*2, 152*a*3 are connected to the air supplier 170 through the same tube, such that the supplying holes 152*a*1, 152*a*2, 152*a*3 supply air at the same rate. However, the disclosure is not limited to the connections shown in FIG. 7A and FIG. 7B. The vacuum holes 152*b* and the supplying holes 152*a* may be connected to the air supplier 170 and the vacuum system 160 through any suitable connection.

Figure 8:
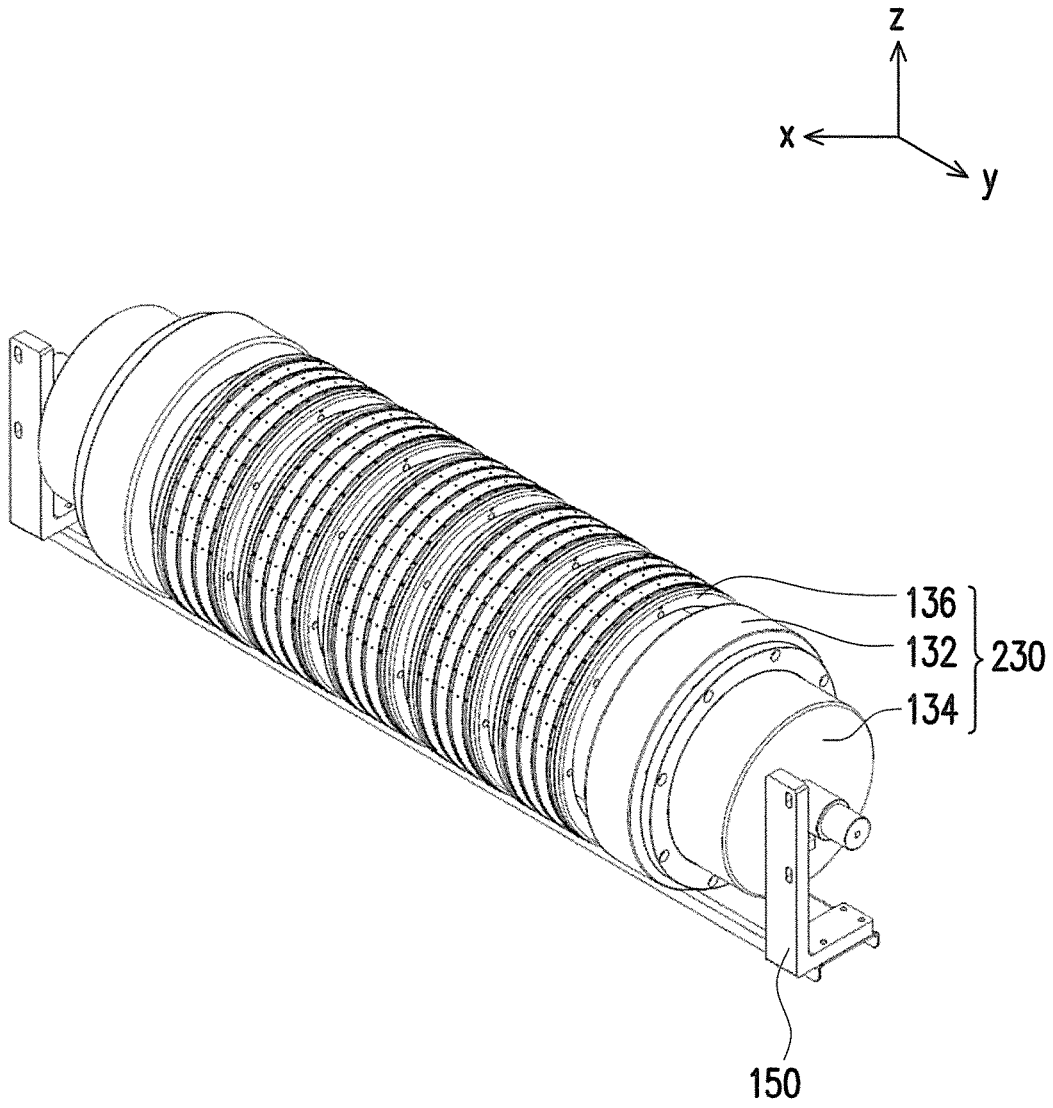
FIG. 8 is a schematic three-dimensional diagram of a step roller according to another embodiment of the disclosure.

FIG. 8 is a schematic three-dimensional diagram of a step roller according to another embodiment of the disclosure. Referring to FIG. 8, the embodiment of FIG. 8 is similar to the embodiment of FIG. 3. Similar elements will use the same reference numerals, and the same description will not be repeated herein. In addition, the step roller 230 of FIG. 8 is suitable to be in the roller assembly 100 of FIG. 1. The difference in the embodiment of FIG. 8 is that the step roller 230 of FIG. 8 includes a plurality of air cylinders 136. The air cylinders 136 are disposed across the entire length between the edge rollers 132. That is to say, the substrate 140 is further supported across the entire length between the edge rollers 132. In the embodiment, five air cylinders 136 are disposed between the edge rollers 132. However, the disclosure is not limited thereto. Depending on the length of the main roller 134 and the distance between the edge rollers 132, the number of air cylinders 136 disposed between the edge rollers 132 may be adjusted. In some other embodiments, the air cylinders 136 are not disposed across the entire length between the edge rollers 132, but only cover a partial length between the edge rollers 132. The disclosure is not limited thereto. In the embodiment of FIG. 8, the number of connecting portions 152 (not shown) of the support frame 150 corresponds to the number of air cylinders 136.

Figures 9, 10:
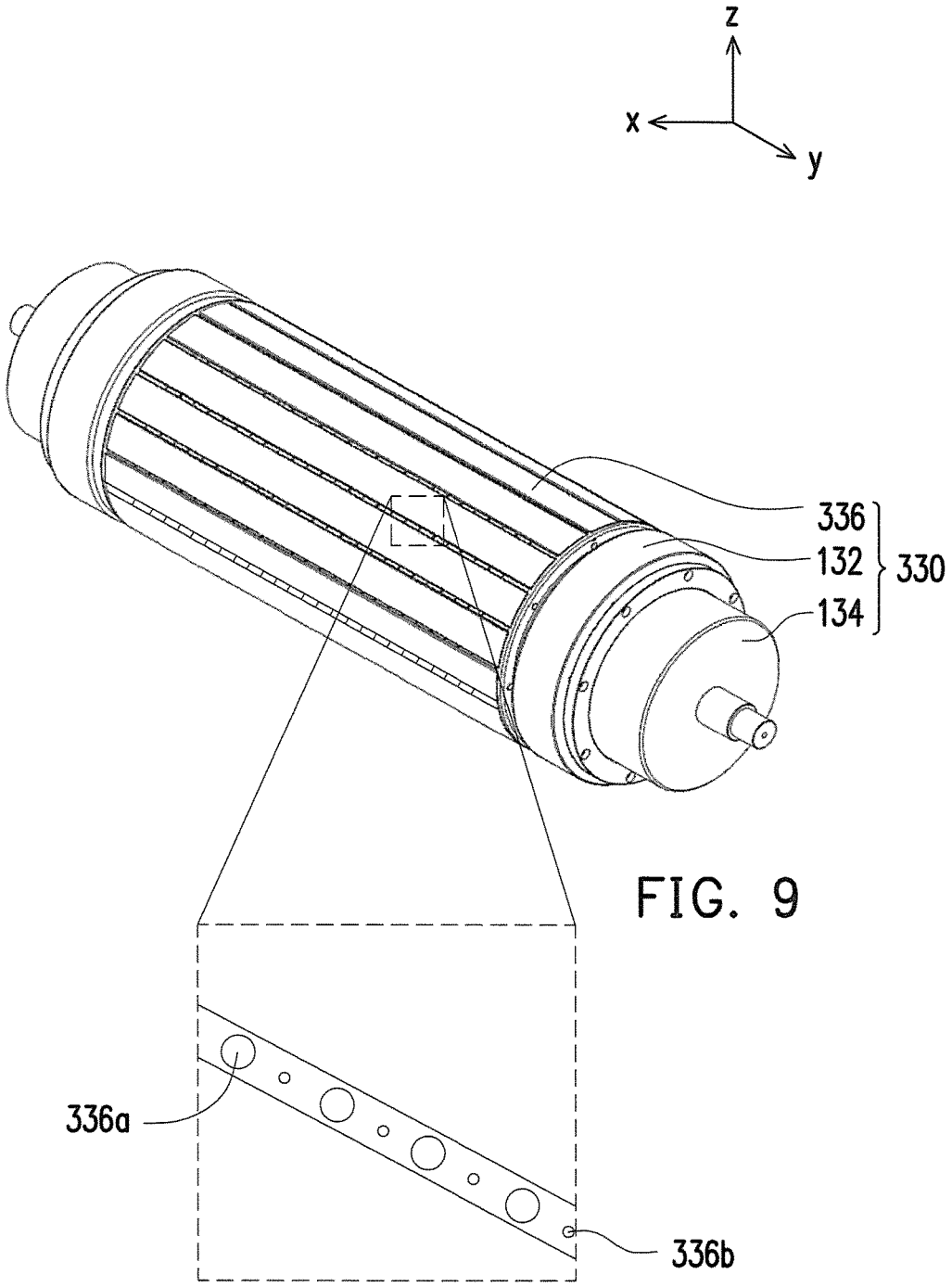
FIG. 9 is a schematic three-dimensional diagram of a step roller according to yet another embodiment of the disclosure.
FIG. 10 is a partial enlarged view of the schematic diagram illustrating the step roller in FIG. 9.

FIG. 9 is a schematic three-dimensional diagram of a step roller according to yet another embodiment of the disclosure. FIG. 10 is a partial enlarged view of the schematic diagram illustrating the step roller in FIG. 9. Referring to FIG. 9 and FIG. 10, the embodiment of FIG. 9 and FIG. 10 is similar to the embodiment of FIG. 3. Similar elements will use the same reference numerals, and the same description will not be repeated herein. In addition, the step roller 330 of FIG. 9 is suitable to be in the roller assembly 100 of FIG. 1. The difference in the embodiment of FIG. 9 is that the step roller 330 of FIG. 9 includes an air cylinder 336. A length of the air cylinder 336 is substantially the same as a distance between the pair of edge rollers 132. In the embodiment, the air cylinder 336 is fixed to the main roller 134 such that the air cylinder 336 rotates with the main roller 134 and the edge rollers 132. That is to say, the air cylinder 336 is in contact with the main roller 134 and rotates with the main roller 134. The air cylinder 336 is fixed and connected to the main roller 134 through, for example, welding, adhering, fastening, or any other suitable method. The disclosure is not limited thereto.

Furthermore, as seen in FIG. 9 and FIG. 10, the air jetting holes 336*a* and the air suction holes 336*b* are arranged in rows along the circumferential direction of the air cylinder 336. In each row, the air jetting holes 336*a* and the air suction holes 336*b* are alternately arranged. Furthermore, the air jetting holes 336*a* and the air suction holes 336*b* are disposed along and surrounding the entire circumference of the air cylinder 336. That is to say, the air jetting holes 336*a* and the air suction holes 336*b* surround the air cylinder 336 completely. When the air cylinder 336 rotates, only the air jetting holes 336*a* facing the substrate 140 jet air, and only the air suction holes 336*b* facing the substrate 140 suction air. The air jetting holes 336*a* and the air suction holes 336*b* are connected to an air supplier (not shown) and a vacuum system (not shown) through any suitable method. That is to say, the air supplier and the vacuum system are controlled such that only the air suction holes 336*b* facing the substrate 140 suction air and only the air jetting holes 336*a* facing the substrate 140 jet air, and the air supplier and the vacuum system are controlled manually or through any suitable method to one of ordinary skill in the art. In other embodiments, the air jetting holes 336*a* and the air suction holes 336*b* are disposed along an arc length of the circumference of the air cylinder 336, similar to the arc length 138 in the embodiment of FIG. 6. In this case, the air cylinder 336 still rotates with the main roller 134, and the air jetting holes 336*a* and the air suction holes 336*b* are only able to jet air and suction air towards the substrate 140 when rotated to face the substrate 140. In some embodiments, the size of the air jetting holes 336*a* may be substantially equal to, greater than or smaller than that of the air suction holes 336*b*. The size of the air jetting holes 336*a* and the air suction holes 336*b* is not limited in this disclosure.

In the embodiments of FIG. 3 and FIG. 8, the step rollers can alternatively be connected the same way without the support frame 150, such that the air cylinder 136 or air cylinders 136 are fixed to rotate with the main roller 134. Furthermore, alternatively in FIG. 3 and FIG. 8, the air jetting holes and the air suction holes may also be disposed along entire circumference. In other embodiments, while the substrate is transported through the step roller, the main roller and the air cylinder are fixed, and the edge rollers rotate. That is to say, the edge rollers are independently connected to separate rotating devices (not shown) such that the edge rollers rotate to transport the substrate. The separate rotating devices are any rotating axle, wheel, connector, or component that can drive the edge rollers to rotate according to one of ordinary skill in the art. Since only the edge rollers rotate, the main roller and the air cylinder do not rotate. Thus, the air cylinder can be connected to an air supplier and vacuum system through the main roller so as to control the air jetting holes and the air suction holes. However, the disclosure is not limited thereto, and the configuration of how to connect to the air supplier or the vacuum system may be adjusted as required by the user.

In the above embodiments, as the substrate 140 is transported along the step roller 130, 230, 330, the stress affecting the substrate 140 due to the bending moment is the strongest at the substrate 140 corresponding to the top of the air cylinder 136, 336. That is to say, the top of the air cylinder 136, 336 is the portion closest to the substrate 140. The pressure of the air jetted from the air cylinder 136, 336, to offset the bending moment is ideally the greatest at the top of the air cylinder 136, 336. However, the disclosure is not limited thereto, and how the pressure of air jetted from the air cylinder 136, 336 is distributed may be adjusted according to user requirements. Depending on how and where the air supplier and vacuum system are connected to the air cylinder 136, 336, the pressure at the top of the air cylinder 136, 336 is not necessarily the greatest.

Figure 11:
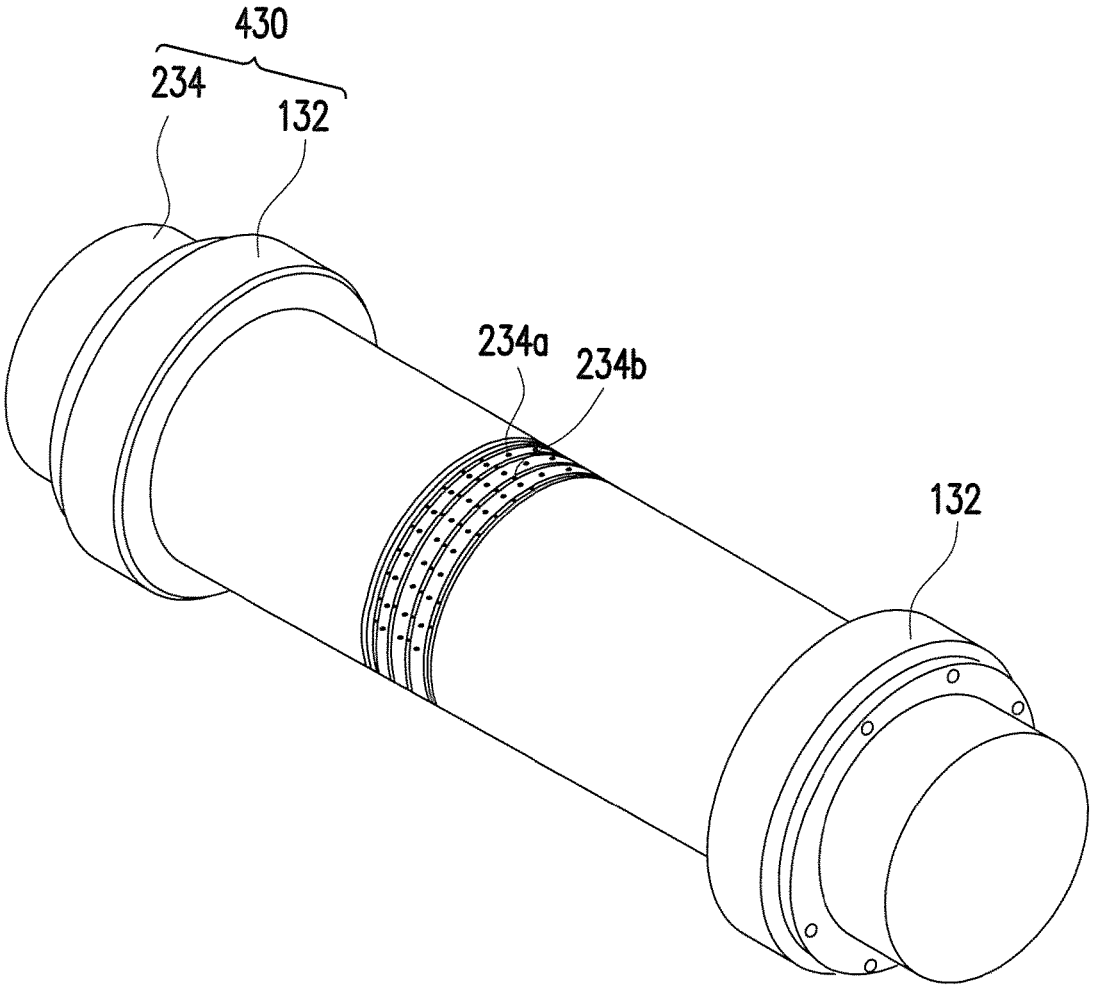
FIG. 11 is a schematic three-dimensional diagram of a step roller according to yet another embodiment of the disclosure.

FIG. 11 is a schematic three-dimensional diagram of a step roller according to yet another embodiment of the disclosure. Referring to FIG. 11, the embodiment of FIG. 11 is similar to the embodiment of FIG. 3. Similar elements will use the same reference numerals, and the same description will not be repeated herein. In addition, the step roller 430 of FIG. 11 is suitable to be in the roller assembly 100 of FIG. 1. The difference in the embodiment of FIG. 11 is that the step roller 430 does not include an air cylinder. The step roller 430 includes the main roller 234 and the edge rollers 132. The main roller 234 of FIG. 11 includes a plurality of air jetting holes 234*a* and a plurality of air suctioning holes 234*b*. Referring to FIG. 11, it can be seen that the air jetting holes 234*a* and the air suction holes 234*b* are respectively aligned in the alternating rows, wherein the rows are in a circumferential direction of the main roller 234. The arrangement is similar to the air jetting holes 136*a* and the air suction holes 136*b* of FIG. 4. In the embodiment of FIG. 11, the air jetting holes 234*a* and the air suction holes 234*b* are disposed near the middle of the main roller 234, and only partially cover the main roller 234 in the length direction. In some other embodiments, the air jetting holes 234*a* and the air suction holes 234*b* are disposed across the entire length between the edge rollers 132. The disclosure is not limited thereto.

In FIG. 11, the air jetting holes 234*a* and the air suction holes 234*b* are disposed along an arc length of the circumference of the main roller 234, similar to the arc length 138 in the embodiment of FIG. 6. While the substrate is transported through the step roller 430, the main roller 234 is fixed, and the edge rollers 132 rotate. That is to say, the edge rollers 132 are independently connected to separate rotating devices (not shown) such that the edge rollers 132 rotate to transport the substrate. The separate rotating devices are any rotating axle, wheel, connector, or component that can drive the edge rollers 132 to rotate according to one of ordinary skill in the art. Since only the edge rollers 132 rotate, the main roller 234 does not rotate. Thus, an air supplier and vacuum system is connected to the air jetting holes 234*a* and the air suctioning holes 234*b* through the main roller 234 to be controlled.

Figure 12:
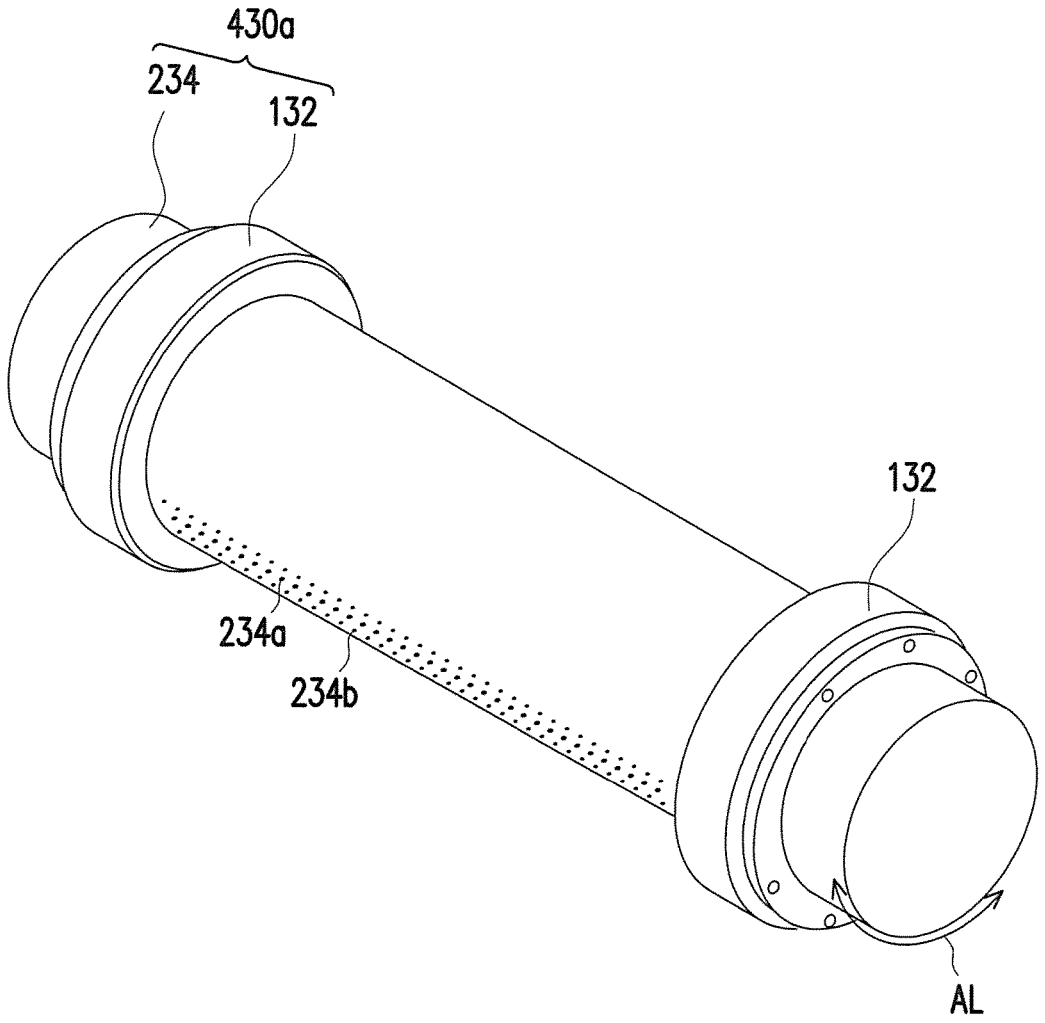
FIG. 12 is a schematic three-dimensional diagram of a step roller according to still another embodiment of the disclosure.

FIG. 12 is a schematic three-dimensional diagram of a step roller according to still another embodiment of the disclosure. Referring to FIG. 11 and FIG. 12, the step roller 430*a* illustrated in FIG. 12 is similar with the step roller 430 illustrated in FIG. 11 except that the main roller 234 of the step roller 430*a* shown in FIG. 12 includes a plurality of air jetting holes 234*a* and a plurality of air suction holes 234*b* arranged thereon, the air jetting holes 234*a* and the air suction holes 234*b* are locally distributed on the circumference of the main roller 234. For example, the air jetting holes 234*a* and the air suction holes 234*b* are disposed on the arc length AL of the circumference of the main roller 234, and the angle of the arc length AL is substantially equal to or less than 180 degrees. In addition, the air jetting holes 234*a* and the air suction holes 234*b* are disposed across substantially the entire distance between the edge rollers 132.

In some alternative embodiments, the main roller 234 of the step roller 430*a* may merely include a plurality of air jetting holes 234*a* or a plurality of air suction holes 234*b* arranged thereon. The air jetting holes 234*a* or the air suction holes 234*b* are disposed on the arc length AL of the circumference of the main roller 234. For instance, the angle of the arc length AL is substantially equal to or less than 180 degrees.

Figure 13:
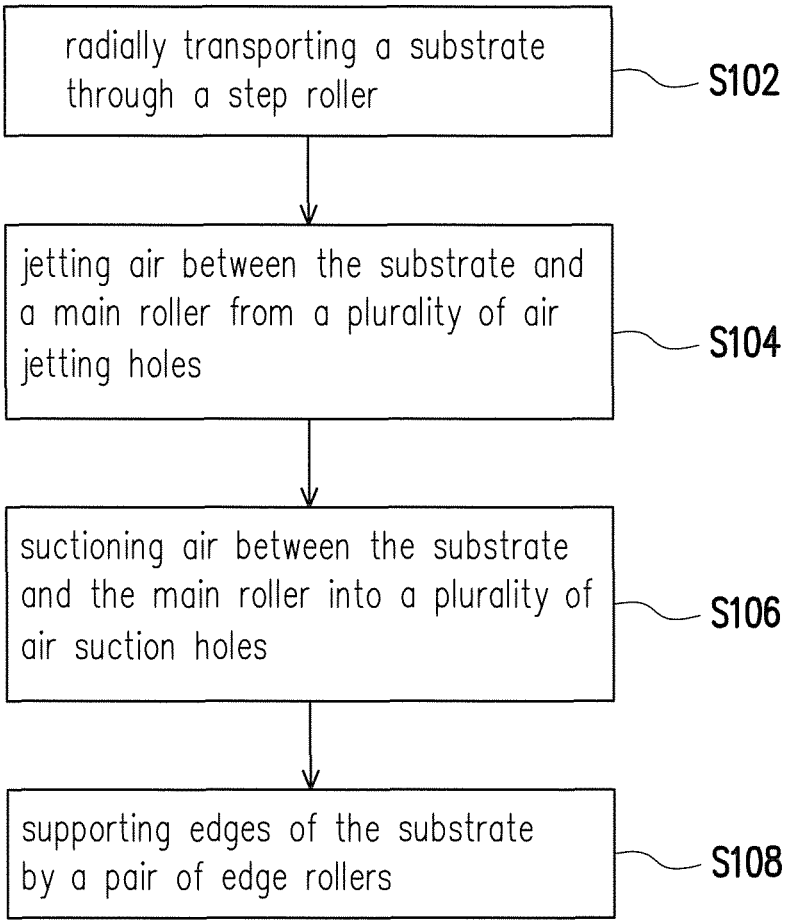
FIG. 13 is a flow chart of a method of transporting a substrate with a roller assembly according to an embodiment of the disclosure.

FIG. 13 is a flow chart of a method of transporting a substrate with a roller assembly according to an embodiment of the disclosure. In step S102, a substrate 140 is radially transported through a step roller 130. Specifically, the substrate 140 is radially transported from a first transport roller 110 to a second transport roller 120 through the step roller 130. In step S104, air is jetted between the substrate 140 and a main roller 134 of the step roller 130 from a plurality of air jetting holes 136*a* of an air cylinder 136 sleeved on the main roller 134. In step S106, air between the substrate 140 and the main roller 134 is suctioned into a plurality of air suction holes 136*b* of the air cylinder 136 sleeved on the main roller 134. In step S108, the edges of the substrate 140 are supported by a pair of edge rollers 132. During the method of transporting the substrate 140 through the step roller 130, the edge rollers 132 and the main roller 134 rotate while the substrate 140 is being transported. The air cylinder 136 is fixed and the main roller 134 rotates while the substrate 140 is being transported. That is to say, the main roller 134 rotates with the edge rollers 132 while the substrate is being transported. Furthermore, the steps S102, S104, S106, and S108 may all be performed at the same time during the transportation of the substrate 140 through the step roller 130. In other embodiments, as described above, the air cylinder and the main roller are fixed while the substrate is being transported, and only the edge rollers rotate. Furthermore, in other embodiments, the air cylinder rotates with the main roller while the substrate is being transported. That is to say, similar to the embodiment of FIG. 9, when the air cylinder rotates, only the air jetting holes facing the substrate jet air, and only the air suction holes facing the substrate suction air.

Figure 14:
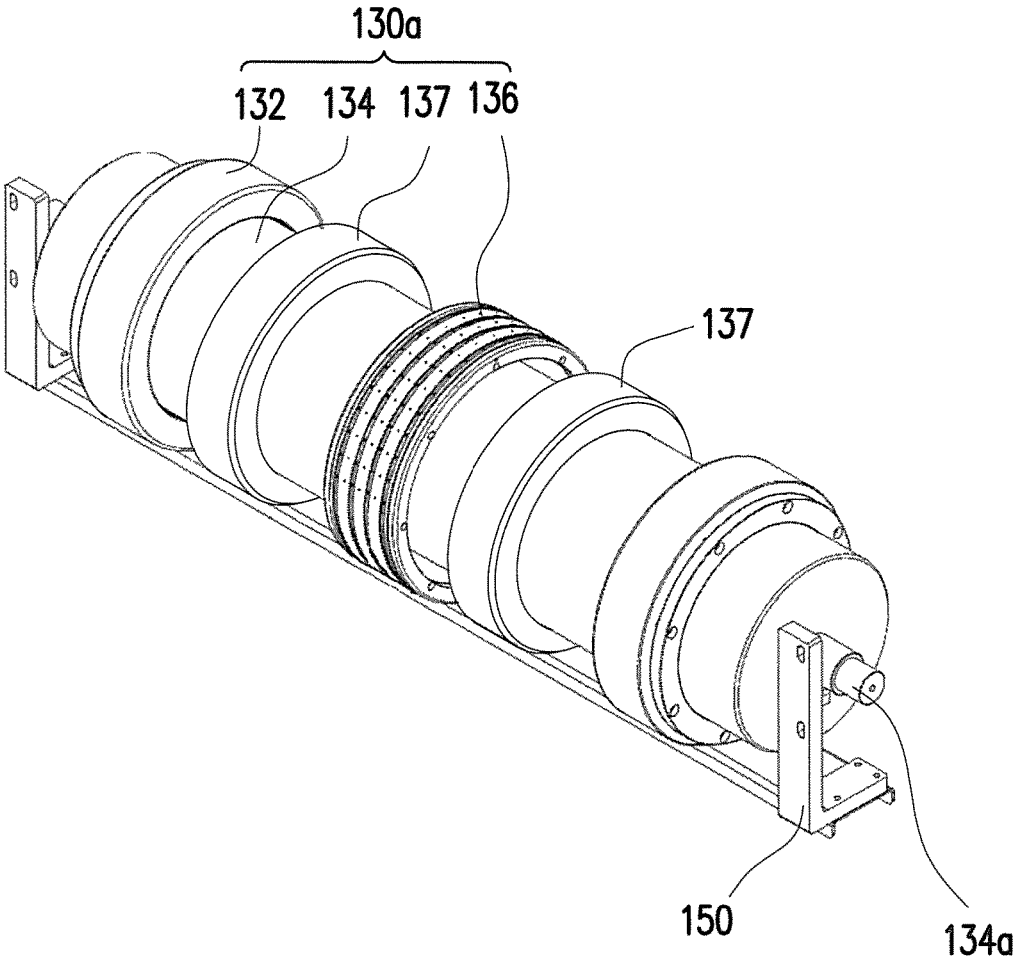
FIG. 14 is a schematic three-dimensional diagram of a step roller according to another embodiment of the disclosure.

FIG. 14 is a schematic three-dimensional diagram of a step roller according to another embodiment of the disclosure. Referring to FIG. 3 and FIG. 14, the step roller 130*a* illustrated in FIG. 14 is similar with the step roller 130 illustrated in FIG. 3 except that the step roller 130*a* further include at least one support roller 137. The at least one support roller 137 is fixed to the main roller 134 through, for example, welding, adhering, fastening, or any other suitable method such that the at least one support roller 137 rotates with the main roller 134.

The substrate 140 (shown in FIG. 1) is in contact with the at least one support roller 137 and while being transported covers about half of the step roller 130*a*. The patterns 142 on the substrate 140 (shown in FIG. 1) do not contact the at least one support roller 137. In some embodiments, two support rollers 137 are disposed on the main roller 134 and each of the support rollers 137 may be arranged between the air jetting holes 234*a* (or the air suction holes 234*b*) and one of the edge rollers 132, respectively.

Figure 15:
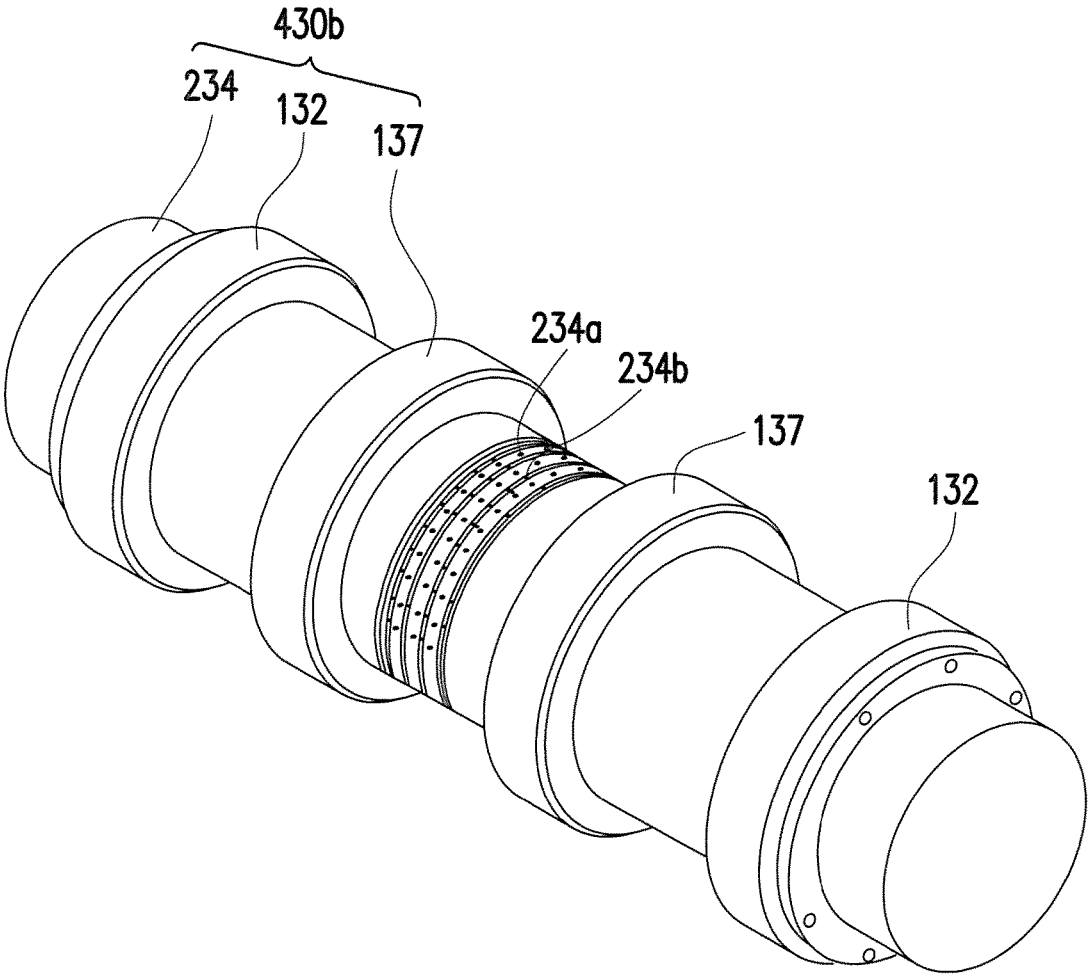
FIG. 15 is a schematic three-dimensional diagram of a step roller according to yet another embodiment of the disclosure.

FIG. 15 is a schematic three-dimensional diagram of a step roller according to yet another embodiment of the disclosure. Referring to FIG. 11 and FIG. 15, the step roller 430*b* illustrated in FIG. 15 is similar with the step roller 430 illustrated in FIG. 11 except that the step roller 430*b* further include at least one support roller 137. The at least one support roller 137 is fixed to the main roller 134 through, for example, welding, adhering, fastening, or any other suitable method such that the at least one support roller 137 rotates with the main roller 234. Furthermore, the substrate 140 (shown in FIG. 1) is in contact with the at least one support roller 137 and while being transported covers about half of the step roller 430*b*. The patterns 142 on the substrate 140 (shown in FIG. 1) do not contact the at least one support roller 137. In some embodiments, two support rollers 137 are disposed on the main roller 234 and each of the support rollers 137 may be arranged between the air jetting holes 234*a* (or the air suction holes 234*b*) and one of the edge rollers 132, respectively.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A roller assembly for transporting a substrate, comprising:

a step roller, including:

a main roller;

an air cylinder sleeved on the main roller, wherein the air cylinder includes a plurality of air jetting holes and a plurality of air suction holes;

a pair of edge rollers disposed on the main roller and disposed on opposite ends of the air cylinder; and a first transport roller and a second transport roller disposed on opposite sides of the step roller, wherein the substrate is transported from the first transport roller to the second transport roller through the step roller.

2. The roller assembly as claimed in claim 1, wherein the step roller further includes at least one support roller disposed on the main roller and disposed between the pair of edge rollers.

3. The roller assembly as claimed in claim 1, wherein the air jetting holes and the air suction holes are disposed on an arc length of a circumference of the air cylinder, and an angle of the arc length is equal to or less than 180 degrees.

4. The roller assembly as claimed in claim 1, wherein the air cylinder is in contact with the main roller and rotates with the main roller.

5. The roller assembly as claimed in claim 1, further including a support frame, wherein the air cylinder is supported by the support frame, and the air cylinder is spaced apart from the main roller and does not rotate with the main roller.

6. The roller assembly as claimed in claim 1, further including a connector connected to the air cylinder, wherein the connector is adapted to be connected to an air supplier and a vacuum system such that the air jetting holes jet air and the air suction holes suction air.

7. The roller assembly as claimed in claim 1, wherein the air jetting holes and the air suction holes are disposed on an arc length of a circumference of the air cylinder.

8. The roller assembly as claimed in claim 1, wherein the air jetting holes and the air suction holes are disposed along the entire circumference of the air cylinder.

9. The roller assembly as claimed in claim 1, wherein a length of the air cylinder is less than a distance between the pair of edge rollers.

10. The roller assembly as claimed in claim 1, wherein a length of the air cylinder is substantially the same as a distance between the pair of edge rollers.

11. The roller assembly as claimed in claim 1, wherein a maximum height from the air cylinder to the main roller is less than a maximum height of the edge rollers to the main roller.

12. A method for transporting a substrate with a roller assembly, comprising:

radially transporting the substrate through a step roller;

jetting air between the substrate and a main roller of the step roller from a plurality of air jetting holes of an air cylinder sleeved on the main roller;

suctioning air between the substrate and the main roller into a plurality of air suction holes of the air cylinder sleeved on the main roller; and supporting edges of the substrate by a pair of edge rollers.

13. The method as claimed in claim 12, wherein the edge rollers rotate while the substrate is being transported.

14. The method as claimed in claim 13, wherein the air cylinder and the main roller are fixed while the substrate is being transported.

15. The method as claimed in claim 13, wherein the main roller rotates with the edge rollers while the substrate is being transported.

16. The method as claimed in claim 13, wherein the air cylinder is fixed or rotates, and the main roller rotates while the substrate is being transported.

17. The method as claimed in claim 16, wherein when the air cylinder rotates, only the air jetting holes facing the substrate jet air, and only the air suction holes facing the substrate suction air.

18. A step roller adapted to transport a substrate, the step roller comprising:

a main roller;

an air cylinder sleeved on the main roller, wherein the air cylinder includes a plurality of air jetting holes and a plurality of air suction holes; and a pair of edge rollers disposed on the main roller and disposed on opposite ends of the air cylinder.

19. The step roller as claimed in claim 18, further including at least one support roller disposed on the main roller and disposed between the pair of edge rollers.

20. The step roller as claimed in claim 18, wherein the air jetting holes and the air suction holes are disposed on an arc length of a circumference of the air cylinder, and an angle of the arc length is equal to or less than 180 degrees.

21. The step roller as claimed in claim 18, wherein the air cylinder is in contact with the main roller and rotates with the main roller.

22. The step roller as claimed in claim 18, further including a support frame, wherein the air cylinder is supported by the support frame, and the air cylinder is spaced apart from the main roller and does not rotate with the main roller.

23. The step roller as claimed in claim 18, wherein the air jetting holes and the air suction holes are disposed on an arc length of a circumference of the air cylinder.

24. The step roller as claimed in claim 18, wherein the air jetting holes and the air suction holes are disposed along the entire circumference of the air cylinder.

25. The step roller as claimed in claim 18, wherein a length of the air cylinder is less than a distance between the pair of edge rollers.

26. The step roller as claimed in claim 18, wherein a length of the air cylinder is substantially the same as a distance between the pair of edge rollers.

27. The step roller as claimed in claim 18, wherein a maximum height from the air cylinder to the main roller is less than a maximum height of the edge rollers to the main roller.

28. A step roller adapted to transport a substrate, the step roller comprising:

a main roller including a plurality of air jetting holes and a plurality of air suction holes arranged thereon;

a pair of edge rollers disposed on opposite ends of the main roller, wherein the air jetting holes and the air suction holes are distributed between the pair of edge rollers; and at least one support roller disposed on the main roller and disposed between the pair of edge rollers.

29. A step roller adapted to transport a substrate, the step roller comprising:

a main roller including a plurality of air jetting holes and a plurality of air suction holes arranged thereon; and a pair of edge rollers disposed on opposite ends of the main roller, wherein the air jetting holes and the air suction holes are distributed between the pair of edge rollers, wherein the air jetting holes and the air suction holes are distributed on an arc length of a circumference of the main roller, and an angle of the arc length is equal to or less than 180 degrees.

30. A step roller adapted to transport a substrate, the step roller comprising:

a main roller including a plurality of air jetting holes or a plurality of air suction holes arranged thereon, the air jetting holes or the air suction holes are disposed on an arc length of a circumference of the main roller, and an angle of the arc length is equal to or less than 180 degrees; and a pair of edge rollers disposed on opposite ends of the main roller, wherein the air jetting holes or the air suction holes are distributed between the pair of edge rollers.

31. The step roller as claimed in claim 30, further including at least one support roller disposed on the main roller and disposed between the pair of edge rollers.

* * * * *